US005989646A

United States Patent [19]

Andersen

[11] Patent Number: 5,989,646

[45] Date of Patent: Nov. 23, 1999

[54] METHOD OF AND SYSTEM FOR MANUFACTURING A WAX IMPREGNATED ROPE AND A WAX IMPREGNATED ROPE

[75] Inventor: Stig Brogård Andersen, Vejle, Denmark

[73] Assignee: A/S N.P. Utzon, Fredericia, Denmark

[21] Appl. No.: 09/101,450

[22] PCT Filed: Jan. 17, 1997

[86] PCT No.: PCT/DK97/00024

§ 371 Date: Jul. 16, 1998

§ 102(e) Date: Jul. 16, 1998

[87] PCT Pub. No.: WO97/26400

PCT Pub. Date: Jul. 24, 1997

[30] Foreign Application Priority Data

Jan. 17, 1996 [DK] Denmark ..... 0043/96

[51] Int. Cl.[6] ..... B05D 1/18; D02G 1/00

[52] U.S. Cl. ..... 427/443; 427/434.6; 428/378; 428/392; 428/396

[58] Field of Search ..... 427/434.6, 434.7, 427/443, 442, 389.9, 392, 394, 396; 428/378, 392, 394, 395, 393, 396; 106/270

[56] References Cited

U.S. PATENT DOCUMENTS

| | | | |
|---|---|---|---|
| 3,079,665 | 3/1963 | Saylor | 28/75 |
| 3,424,608 | 1/1969 | Marzocchi et al. | 117/72 |
| 3,911,785 | 10/1975 | Hood | 87/1 |
| 3,960,050 | 6/1976 | Eisler | 87/1 |
| 5,180,325 | 1/1993 | Eddins et al. | 446/385 |

FOREIGN PATENT DOCUMENTS

| | | |
|---|---|---|
| 2 181 466 | 4/1987 | United Kingdom . |

*Primary Examiner*—Shrive Beck
*Assistant Examiner*—Jennifer Calcagni
*Attorney, Agent, or Firm*—Sixbey, Friedman, Leedom & Ferguson; David S. Safran

[57] ABSTRACT

Ropes made of plastic filaments are used extensively for fishing equipment such as nets and trawl bags, and it has been found that a wax impregnation of the ropes is advantageous in several respects. However, the presence of free wax on the rope surface is undesirable, and according to the invention this is avoided by moving the rope through an impregnation unit (1) comprising a warm wax bath, in such a controlled manner that the rope is only partially saturated, whereafter the rope is air heated at a temperature higher than the melting point of the wax in order for the free surface wax to penetrate into the rope surface.

13 Claims, 1 Drawing Sheet

METHOD OF AND SYSTEM FOR MANUFACTURING A WAX IMPREGNATED ROPE AND A WAX IMPREGNATED ROPE

The present invention relates to a method of manufacturing wax impregnated rope.

In particular for fishing equipment such as nets and trawl bags and the like it is desirable that the ropes used for the forming or binding of these objects are as ductile and handy as possible and very important that they maintain their strength and dimension during long time of use. The ropes for this purpose are normally made from artificial material, mostly of Nylon.

For preserving the strength and the knot stability of a rope and for making it wear resistant it is known to effect a wax treatment thereof in connection with the rope production. This also has the purpose to make the rope more ductile and handy.

Another purpose of such a treatment is to prevent that the rope, when used in water e.g. for fishing, takes up water and thus becomes heavier and more difficult to handle, while also its tensile strength decreases. Moreover, a wax treatment of the rope may prevent sand particles from entering the rope, where the sand, in use, may wear on the filaments of the rope such that the strength of the rope is reduced, resulting in rupture hazards with potential, very serious consequences. Also, the wax treatment will reduce the internal friction in the rope as the filaments can more easily slide on each other when the rope is stretched, slackened or bent.

Thus, for an efficient treatment of the rope it is desirable to achieve an impregnation, whereby the wax is deposited between and around the filaments of the rope. It is a possibility to arrange a current waxing of the filaments or strands of which the rope is made, as these may be guided briefly through a bath with warm, liquid wax. This may result in a fine impregnation, but normally the method will imply noticeable difficulties in the rope production, where unconvenient wax deposits are liable to occur at critical places of the machinery, while also the generally wax greasy filaments are difficult to handle in the production of the rope.

It has been found more suitable, therefore, that it is the finished rope that is subjected to the impregnation treatment. In this connection, the rope should not only be surface treated, but deep impregnated, and according to GB 1,296,339 it has even been suggested to make use of a real pressure impregnation, inasfar as it is proposed that a multi core cable to be correspondingly treated is moved through a treating chamber to which an impregnation agent is supplied under pressure. In connection with rope, however, it has not been found necessary to use such a method, because a sufficient wax intrusion may be achieved solely by passing the rope through a wax bath through a suitable distance or duration.

In both cases, however, there will be left a noticeable wax coating on the outer surface of the rope. It is attractive that the rope be feelable as being 'wax impregnated', but this is soon turned into a drawback if a real wax layer is exposed on the surface, even if the layer is very thin. It is possible to minimize the thickness of the layer by subjecting the rope to a scraping or by squeezing it between opposed clamping rollers, already for reducing the wax consumption, but is has been found that even hereby it is difficult to avoid the non-desired greasy character of the rope as caused by even the slightest occurrence of free wax on the surface.

It should be considered that the wax is left in a natural condition, i.e. in a solidified, semi rigid state by the cooling after the rope passage through the warm wax bath, without any kind of further fixation of curing. It is known to use other, environmentally and operatively less attractive impregnation agents, which may be subjected to real curing, cf. U.S. Pat. No. 3,424,608 and U.S. Pat. No. 3,911,785, e.g. by a subsequent passage of the impregnated rope through a heating zone. Hereby, of course, even a remaining outer layer of the impregnation agent may be caused to become non-sticky or non-greasy, but this has no bearing on the present invention, which is concentrated on the use of environmentally clean and non-able, pure wax as the impregnation agent.

By extensive tests in connection with the invention it has been found that in fact it is possible to obtain a rope surface which, after the passage of the rope through a warm wax bath, is entirely free of surplus wax, viz. in that the rope before or for that sake after a cooling following its passage through the warm wax bath is moved through a heating zone for heating of the impregnation wax to above its melting temperature. This treatment will have nothing to do with a curing of the impregnation agent, but to the contrary with a fluidization thereof, such that by an existing capillary action the wax will draw inwardly in the rope, partly for completion of the interior impregnation and partly for removal of surplus wax from the outer surface. It has been found possible to hereby achieve an ideal result with respect to the surface being liberated for free wax, yet maintaining its character of being wax impregnated.

Hereby the said operative advantages are achievable while the rope appears non-greasy and is suitable for stable knot binding in connection with fishing nets, trawl bags and the like.

It is important to notice that the running-through impregnation of the rope should be controlled in such a manner that the rope is not fully impregnated, as there will not otherwise be the required capacity for the take up of the surplus wax on the exterior surface.

Moreover, it is important to note that the application of the warm wax with its associated intensive heating of the rope filaments will present a problem which is already known in connection with any heating treatment of ropes: A heating is or may be highly desirable in order to produce a precrimping of the ropes, such that it will thereafter be resistant to such a crimping which would otherwise, inevitably, occur in practical use of the rope as a result of relaxation of internal stresses originating from the production of the filaments and/or the rope making. For some uses or products, e.g. for trawl bags, it is important that the rope used for making the product is generally pre-crimped i.e., pre-shrunk so as to show a very low residual crimpability when taken in use, because further uneven crimping, e.g. up to an extent of 10% may result in disadvantageous wrynesses of the product. The other side of the problem is that any heating of the virgin rope will inevitably result in a reduction of the strength of the rope, the more the higher the temperature goes.

For any rope product, therefore, it should be considered whether the strength or the residual crimpability has the first priority for the intended use. In connection with the present invention it has been found possible to aim at both a very low residual crimpability (i.e., degree to which it will shrink further) of only 0–1.5% and a relatively low strength reduction, while this value is normally higher for effectively precrimped ropes.

For these combined reasons it is important that the rope should be in contact with the warm wax bath for seconds only, e.g. less than 10 seconds or even for less than one second, while the following heating in air may extend over e.g. 5–30 minutes in order to achieve the desirable wax distribution without seriously further reducing the rope strength.

Thus, it is rather critical to adjust the resident time of the rope in the wax bath in accordance with the desired properties of the final rope product, and in general this will be a matter of empirical adjustment of the process parameters.

The degree of wax absorption and crimping can be controlled by the temperatures of the wax bath and the heating zone, respectively, as well as by the associated duration of the rope passage therethrough. The dimension of the rope is important, as a thick rope may well require twice the treating time in the heating zone compared with a thin rope.

A preferred wax is of the type known as micro crystalline wax, having a melting point of about 75° C. The temperature of the wax bath may be some 80–100° C. or more, and normally it will be sufficient to arrange for the rope to dip through the bath rather briefly, e.g. during some 2 seconds. Thereafter, when surplus wax has been squeezed off, the rope should continue into a heating unit with an air temperature of e.g. 120–130° C., ranging preferably between 100 and 150° C. The residence time of the rope in the heating unit is comparatively long, e.g. some 10 minutes, ranging generally between some 5 and 20 minutes or more. This does not mean that the rope should be moved particularly slowly, inasfar as it may be present at great length in the heating unit. In this unit the rope should be guided such that it is free to undergo the said shrinking to the desired extent.

Preferably, after the heating unit the rope should be subjected to some cooling, sufficient to make the wax solidify before a following coiling of the rope, as it may then be coiled without sticking problems.

As mentioned, the preferred wax has a melting point of about 75° C., whereby it is taken into account that the wax impregnation can be resistant to sun heating, without the turns of a rope coil left in the sun sticking together by subsequent cooling. However, the invention is not limited to the use of wax with any particular melting point and thus not either to any particular temperature range of the wax bath. The bath should be at least a few degrees warmer than the melting point of the applied wax, but with a relatively cool bath the dripping time should be increased again without specific limits. On the other hand the bath temperature should of course not be hither than the degeneration temperature of the wax or so high as to cause damage to the rope.

Correspondingly, it is difficult to indicate specific limits for the dipping time and the duration and temperature of the air heating of the rope. At an elevated air temperature the desired 'retraction' of the surface wax into the rope might be effected in half a minute, but a longer treating time is preferred anyway, also for achieving the desired shrinkage of the rope. At a relatively low heating temperature the rope will be treated more gently, but then a heating time of e.g. 90 minutes may be desirable.

The rope itself, when properly treated, exhibits a remarkable character in that even when unravelled there is no visible deposit of wax, not either on the single strands or filaments. There is a small amount of adhesion or rather 'packing together' between the finest filaments, but not between the strands, so the rope is well suited for easy splicing. Thus, it is apparent that the wax has really been drawn off from the surface of the strands, even where these touch one another, yet leaving the surface "impregnated from the inside". The surface is less glossy than normally for ropes of Nylon or the like, and it can be touched with a pleasant soft feeling ("soft hand"). In use, the smooth and compact surface will account for a low water resistance when the rope products are dragged through the water, and the rope will maintain its dimensions, with insignificant residual crimping (0–1.5%) and without swelling or otherwise increase its thickness.

BRIEF DESCRIPTION OF THE DRAWINGS

In the following the invention is described in more detail with reference to the drawing, in which.

Figure 1:
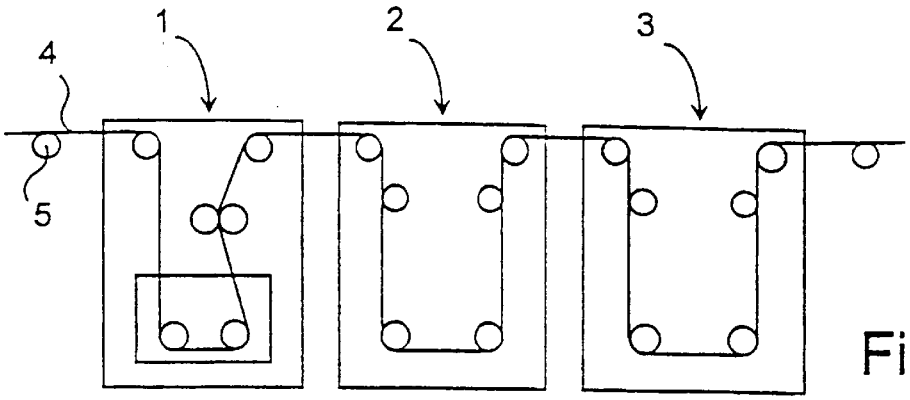
FIG. 1 is a schematic view of a modular production system for manufacturing of wax impregnated ropes according to the invention.

According to FIG. 1, a rope 4 made by a conventional production system (not shown) is guided by guiding means 5 first through an impregnation module 1, then through a heating cabinet module 2 and finally through a cooler cabinet module 3, whereafter the rope is coiled in a non-illustrated coiling station. In each of the modules 1,2 and 3 and if required even between them the rope is guided and advanced by guiding means 5 made as wheels or cylinders. Some of them may be driving. The rate of advance can be controlled by a control unit (not shown).

Figure 2:
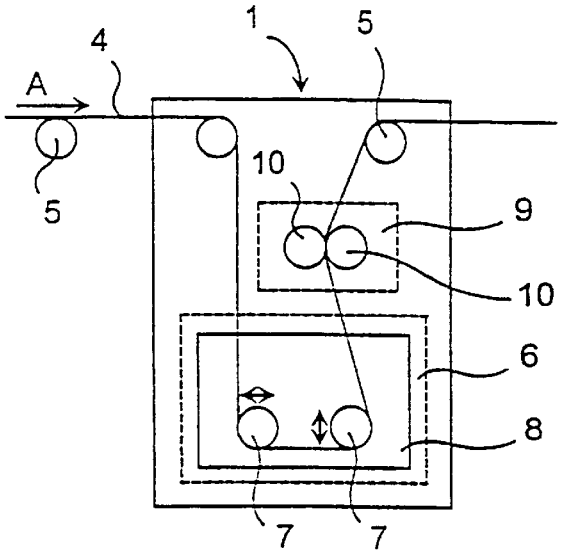
FIG. 2 is a schematic view of an impregnation module.

In FIG. 2 the impregnation module 1 is shown in more detail. A rope 4 enters the module in a mainly horizontal direction as shown by the arrow A, via a guiding means 5, whereafter the rope changes direction to substantially vertical and is moved down into an impregnation section 6 holding a wax bath 8. In this bath the rope is guided by two guiding rollers 7 which are displaceable horizontally and vertically, whereby the submerged length of the rope can be adjusted. The rope 4 moves substantially horizontally between the rollers 7 and leaves the wax bath 8 and the unit 6 upwardly, whereafter it passes through a unit 9 for removal of surplus wax, if any, on the rope. This unit consists of two squeezing rollers 10 at opposed sides of the rope 4. The rollers 10 are pressed together with a force which is adjustable according to the amount of wax to be squeezed out of the rope. Thereafter the rope 4 leaves the impregnation module 1.

Figure 3:
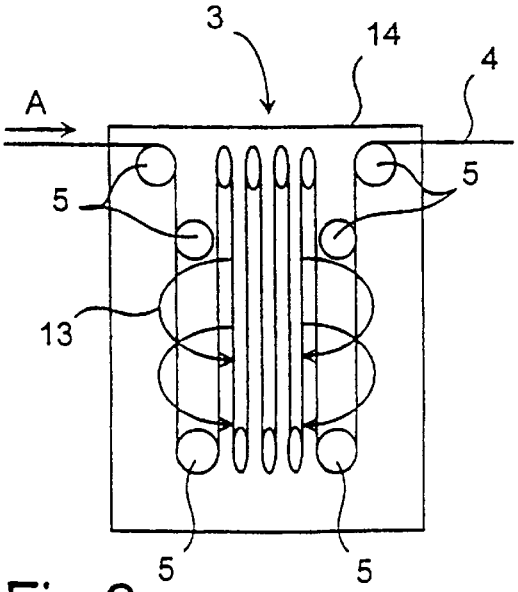
FIG. 3 is a schematic view of a cooler cabinet module.

The heating cabinet module 2, FIG. 3, receives the rope 4 into a closed, insulated chamber 11 which is heated to between 80 and 160° C. Inside this chamber 11 the rope is guided by a plurality of guiding members 5. The air is kept in constant motion by suitable agitation means, as indicated by arrows 12. Hereby a more even heat distribution in the rope 4 is obtainable.

In the cabinet 11 the rope is guided through a plurality of loops, e.g. 20–30 loops, whereby a cabinet of a reasonable size may hold a noticeable length of rope, e.g. 50–100 m. The guiding means, e.g. comprising individually rotatable carrier pulleys, should be adapted so as to allow for the relevant shrinkage (crimping) of the rope, preferably amounting to some 8–15% and implying that the roap speed is somewhat lower at the outlet than at the inlet. The inlet speed may be of the magnitude 5–25 meters per minute.

Figure 4:
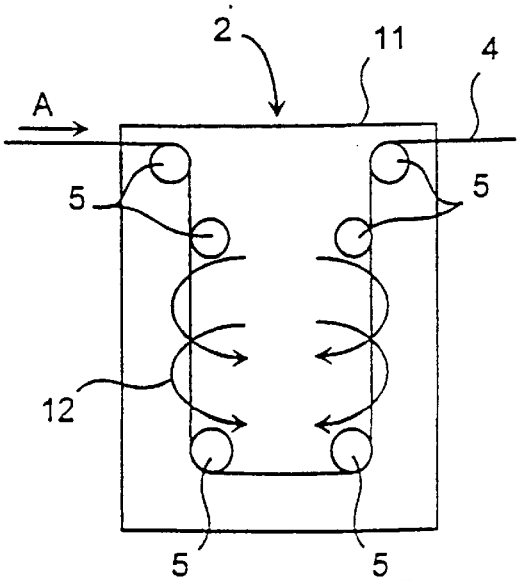
FIG. 4 is a schematic view of a cooler cabinet module.

From the heating unit 2 the rope continues to the cooling unit 3 which, as shown in FIG. 4, may be practically identical with the unit 2, except for its cabinet 14 being held cooled at some 0–30° C. in order to make the warm wax solidify. Also here, it is preferred to make use of air circulation as shown at 13.

As mentioned, a correct treatment of any new rope product will have to be empirically based, taking into account the desired properties with respect to shrinkage and strength. On the other hand, once suitable processing parameters have been ascertained, such parameters will then be reusable for achieving fully reproduceable results as long as the particular rope product is not changed.

The following two comparative examples may be illustrating:

EXAMPLES

Two three strand Nylon ropes with diameters 11 and 16 m, respectively, are subjected to an impregnation treatment according to the invention. The following parameters are chosen:

| Rope diameter | 11 mm | 16 mm |
|---|---|---|
| Speed through wax bath | 15 m/min | 9 m/min |
| Submerged rope length | 200 mm | 250 mm |
| Bath temperature | 100° C. | 100° C. |
| Residence time in bath | 0.8 sec. | 1.7 sec |
| Rope length in heater unit | 80 m | 80 m |
| Temperature of heater unit | 120° C. | 125° C. |
| Residence time in heater unit | 5.3 min | 8.8 min |
| Rope length in cooler unit | 80 m | 80 m |
| Temperature in cooler unit | 23° C. | 23° C. |
| Crimping | | 10–13% |
| Weight increase | | 5% |
| Strength reduction | | 10% |
| Residual crimping | | 0.5% |

I claim:

1. A method of manufacturing a wax impregnated rope, characterized in that the rope is moved through a warm bath of melted wax so as to become widely impregnated with wax, whereafter the rope, in a state not fully saturated with wax, is subjected to air heating at a temperature above the melting point of the wax for a period sufficient for the wax to be further distributed into the rope such that surplus wax at the surface of the strands of the rope is drawn into the strands, leaving the strands substantially without any exterior wax deposits.

2. A method according to claim 1, in which the non-saturated state of the rope is produced by controlling the residence time of the rope in the wax bath to be insufficient for a complete saturation of the rope.

3. A method according to claim 1, in which the non-saturated state of the rope is produced by squeezing the rope in a substantially fully saturated condition thereof.

4. A method according to claim 1, in which the residence time of the rope in the wax bath is less than 10 seconds.

5. A method according to claim 2, in which the residence time of the rope in the wax bath is less than 10 seconds.

6. A method according to claim 1, in which the duration of the air heating is 0.5–90 minutes.

7. A method according to claim 6, in which the rope is guided through a heating zone in such a manner as to produce a pre-crimping thereof while the wax is drawn into the strands of the rope.

8. A method according to claim 6, in which the rope is guided from the heating zone into and through a cooling zone for solidifying the wax, whereafter the rope passes further to a coiling station.

9. A method according to claim 2, in which the residence time of the rope in the wax bath is less than 4 seconds.

10. A method according to claim 2, in which the residence time of the rope in the wax bath is less than 0.5 seconds.

11. A method according to claim 1, in which the duration of the air heating is 5–30 minutes.

12. A wax impregnated rope, characterized in that the rope is substantially fully impregnated with wax, is substantially free of exterior wax deposits at the surface of the strands of the rope, and has been subjected to shrinkage to an extent that the rope has a residual shrinkage of less than 2%.

13. A wax impregnated rope according to claim 12, wherein said residual shrinkage is less than 0.5%.

* * * * *